US006315434B1

(12) United States Patent
Long

(10) Patent No.: US 6,315,434 B1
(45) Date of Patent: Nov. 13, 2001

(54) ONE-PIECE COLLAPSIBLE LAMPSHADE

(75) Inventor: Alan M. Long, Little Rock, AR (US)

(73) Assignee: Cheyenne Industries, Inc., Little Rock, AR (US)

( * ) Notice: Subject to any disclaimer, the term of this patent is extended or adjusted under 35 U.S.C. 154(b) by 0 days.

(21) Appl. No.: 09/645,378

(22) Filed: Aug. 24, 2000

(51) Int. Cl.[7] ..... F21V 1/06

(52) U.S. Cl. ..... 362/352; 362/356; 362/358; 362/434; 362/450

(58) Field of Search ..... 362/351, 352, 362/355, 356, 357, 358, 434, 450

(56) References Cited

U.S. PATENT DOCUMENTS

| | | | | |
|---|---|---|---|---|
| 2,884,515 | * | 4/1959 | Fogel | 362/358 X |
| 4,075,684 | | 2/1978 | Witz | 362/352 |
| 4,120,027 | | 10/1978 | Stark | 362/352 |
| 4,165,529 | | 8/1979 | Hagelthorn | 362/352 |
| 4,212,052 | | 7/1980 | Chambard | 362/352 |
| 4,233,656 | | 11/1980 | Shemitz | 362/352 |
| 4,290,099 | | 9/1981 | Vicars-Harris | 362/352 |
| 4,354,222 | | 10/1982 | Gall | 362/352 |
| 4,605,996 | | 8/1986 | Payne | 362/352 |
| 4,714,987 | | 12/1987 | Dene | 362/352 |
| 4,727,461 | | 2/1988 | Naumoff et al. | 362/352 |
| 4,731,716 | | 3/1988 | Chang | 362/352 |
| 4,758,936 | | 7/1988 | Maxwell | 362/352 |
| 4,772,992 | | 9/1988 | Tang | 362/352 |
| 4,994,949 | | 2/1991 | Yeh et al. | 362/352 |
| 5,375,048 | | 12/1994 | Barnes | 362/352 |
| 5,868,492 | | 2/1999 | Strickland | 362/352 |
| 6,030,087 | * | 2/2000 | Whittle | 362/352 X |

* cited by examiner

*Primary Examiner*—Sandra O'Shea
*Assistant Examiner*—John Anthony Ward
(74) *Attorney, Agent, or Firm*—J. Charles Dougherty

(57) ABSTRACT

A one-piece, collapsible lampshade is disclosed. The invention comprises an upper and lower ring, between which a shade is attached. Supports are permanently attached to one ring, with each support having a hinge part-way along its length. Receptacles are mounted on the opposite ring to receive the unattached end of the supports. The shade may be shipped and stored in the collapsed state by removing the unattached end of the supports from the receptacles and folding the supports flat. Because the shade is shipped and stored in one piece, it is easily and quickly assembled by the purchaser, without the risk of losing parts or of damage during shipment due to the movement of loose parts against one another.

32 Claims, 3 Drawing Sheets

ONE-PIECE COLLAPSIBLE LAMPSHADE

BACKGROUND OF THE INVENTION

The present invention relates to lampshades, and in particular to lampshades of the collapsible or "knock-down" variety, which may be shipped and stored in an essentially flat form and then easily assembled by a consumer for use.

Most lampshades designed for use with decorative electric lamps cannot be disassembled for shipment and storage. Since lampshades are typically quite light but bulky, they occupy considerably more space per unit weight when shipped than other manufactured products. Since the cost of shipping, particularly transoceanic shipping, is often based on volume, not weight, the cost of shipping lampshades either from overseas manufacturers or to overseas markets is relatively high. In addition, large retailers often measure the success of a particular product based on the dollar amount of sales per unit of shelf space occupied by the product. Thus even popular lampshades may be disfavored by such retailers in favor of other merchandise, given the large amount of shelf space occupied by the product and its relatively low cost.

Numerous attempts have been made to design collapsible lampshades to ameliorate these problems. For example, U.S. Pat. No. 5,375,048 to Barnes discloses a collapsible lampshade frame with annular upper and lower support members connected by rib members. The rib members are pivotally mounted at each end to one of the support members. A hinge is located in the middle of each rib member, allowing it to fold such that the frame can lie flat with the rib members folded in half. A spider member is connected to each rib member by means of annular slides, with a rib member passing through each slide. By moving the slides of the spider member over the rib member hinges, the rib members are prevented from folding, thereby locking the lampshade frame in its unfolded state. To fold the frame, the slides of the spider member are moved up or down such that the hinges can again operate freely. The lampshade cover is not integrated with the frame, but is instead fitted over the frame part-way through the unfolding process.

U.S. Pat. No. 5,868,492 to Strickland discloses a lampshade including a shade, a flexible member, and a rigid support. The shade is formed of a continuous resilient, pleated band. The flexible member passes through holes adjacent to one end of the band. The shade has notches near its middle on the interior side, which are designed to receive the rigid support. To lock the lampshade in its unfolded state, the rigid support is placed within the shade at the end opposite the flexible member, then pushed toward the flexible member until the rigid support locks into place in the notches on the interior of the shade. The result is a shade having a frusto-conical shape due to the tension formed at the narrow end of the shade by the flexible member.

U.S. Pat. No. 4,772,992 to Tang discloses a lampshade of frusto-conical shape with a plurality of clips permanently secured within each of its ends in circumferentially spaced positions. To support the shade, two rigid rings are snapped into the clips. The rigid rings may be removed so that the lampshade can be folded for shipment or storage.

U.S. Pat. No. 4,714,987 to Dene discloses a frusto-conical lampshade, with an outer shell fitted over the smaller end of the shade. An inner shell of larger diameter is fitted within the shade, and drawn toward the outer shell, with a bolt passing through each of the shells to hold them together. The compression of the shade between the inner and outer shells holds the shade in the desired shape. The shade may be folded for shipment or storage by removing the bolt between the shells.

U.S. Pat. No. 4,354,222 to Gall discloses a knock-down lampshade frame formed of two ring members, with one ring member having a spider member affixed thereto. A plurality of rib members connect the ring members by means of releasably securing clamping members. The shade is a separate piece, designed to fit over the frame after assembly.

U.S. Pat. No. 4,290,099 to Vicars-Harris discloses a knock-down lampshade consisting of a pair of rings and a plurality of connecting rods. At the free end of each rod is a T-shaped socket part which snaps onto the rings to form the lamp shade frame. The lamp shade cover is then sewn, clipped, or otherwise adhered to the frame after assembly.

Each of these lampshades suffers from the disadvantage that, when in the knocked-down or collapsed state, the lampshade consists of a plurality of separate parts. Shipping the lampshade in multiple parts increases the likelihood that the lampshade will be damaged during shipment, since the parts may move with respect to each other within the lampshade packaging, thereby tearing or otherwise damaging the shade itself. Packaging designed to prevent such movement increases the cost of production for such lampshades. Also, once the consumer purchases the lampshade, assembly is made more complicated by the use of multiple parts. In addition, the use of multiple parts increases the likelihood that the consumer may misplace one of the smaller lampshade parts, thereby rendering the lampshade unusable. This likelihood increases if the consumer uses the lampshade for a period, then desires to ship or store the lampshade in the knocked-down state as, for example, when the consumer moves to a new home. What is desired therefore is a lampshade that may be shipped and stored in a collapsed form, may be easily assembled by the purchaser, and is formed with the lampshade and frame being one integrated part to reduce the likelihood of damage during shipment, and reduce the likelihood that smaller parts may be misplaced.

Some of the lampshades described above also suffer from the disadvantage that, due to their design, they are inherently limited to a particular shape, such as frusto-conical. What is desired is a knock-down lampshade that may be manufactured in many different shapes to provide the consumer with a multitude of lampshade styles from which to choose.

SUMMARY OF THE INVENTION

The present invention is directed to a one-piece, collapsible lampshade that may be easily assembled by the purchaser and may be manufactured in many different shapes. The frame consists of two rings integrated into the upper and lower ends of a lampshade. Attached to one ring is a plurality of supports. Each support has a hinge part-way along its length, which allows the support to fold when the lampshade is in the knocked-down state. To use the lampshade, the supports are unfolded, and the unattached support ends are snapped into a corresponding number of receptacles attached to the opposite ring. One ring may include a spider member as an attachment point between the lampshade frame and the lamp.

The present invention may be easily assembled by a purchaser in a matter of a few seconds, by simply unfolding the supports and snapping them into place. The shade and frame are integrated, such that the lampshade forms a single part in either the collapsed or assembled state. The purchaser may also disassemble the lampshade within a few seconds for later storage or shipment, without the possibility of losing smaller frame parts that are unattached from the shade during disassembly.

Because of the design of the present invention, the lampshade itself may be formed into a multitude of different shapes. While the traditional frusto-conical lampshade is one of these possible shapes, the invention is not limited to this shape. Cylinder, bell, and polygonal shapes are among those many other shade shapes possible with the present invention.

It is therefore an object of the present invention to provide for a one-piece collapsible lampshade and frame unit.

It is a further object of the present invention to provide for a knock-down lampshade that may be shipped in the collapsed state with a reduced likelihood of damage due to loose parts within the packaging.

It is also an object of the present invention to provide a knock-down lampshade that may be quickly and easily assembled and disassembled.

It is yet another object of the present invention to provide a knock-down lampshade that may be manufactured in a multitude of different shapes and styles.

These and other features, objects and advantages of the present invention will become better understood from a consideration of the following detailed description of the preferred embodiments and appended claims in conjunction with the drawings as described following:

DETAILED DESCRIPTION OF THE INVENTION

Figure 1:
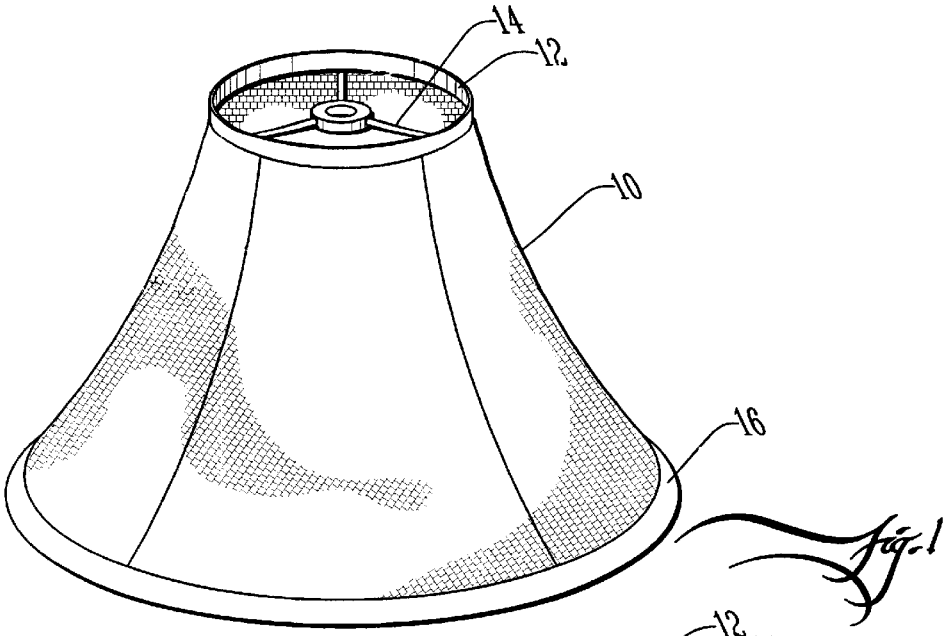
FIG. 1 is a top perspective view of a preferred embodiment of the invention in the assembled state.
Figure 2:
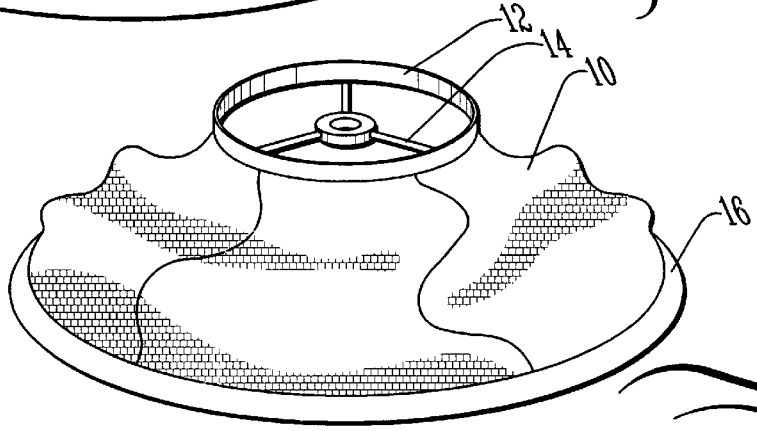
FIG. 2 is a top perspective view of a preferred embodiment of the invention in a partially collapsed state.
Figure 3:
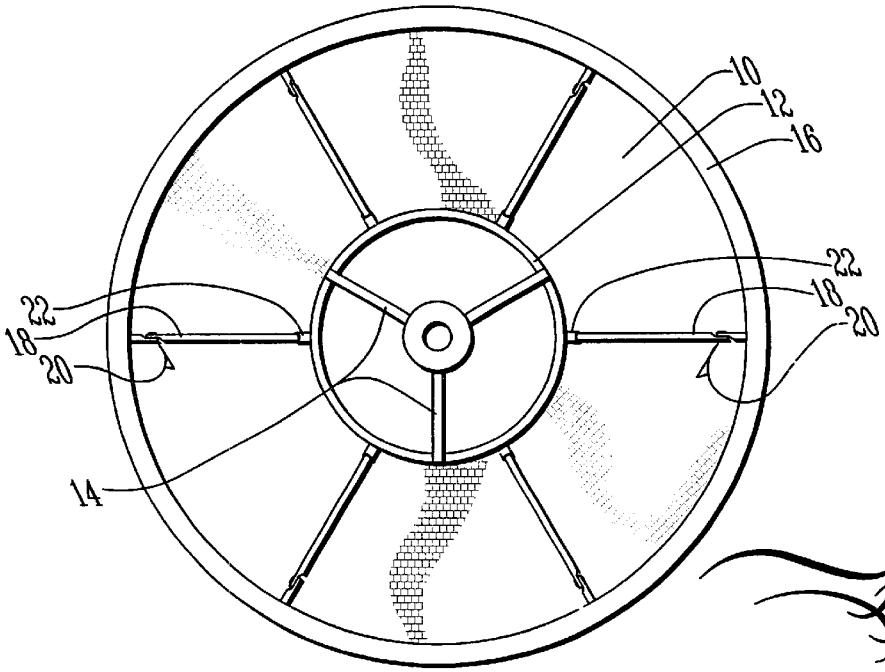
FIG. 3 is a bottom plan view of a preferred embodiment of the invention in the assembled state.

With reference to FIGS. 1–4, the preferred embodiment of the present invention may be described. Shade 10 is preferably formed of cloth fabric, but can be of any other material that may be stretched taut over the frame of a lampshade. The shape of shade 10 in the illustrated embodiment is that of a bell, but shade 10 can be of many other shapes, including frusto-conical, cylindrical, and polygonal. Upper ring 12 and lower ring 16 are attached to shade 10 at its upper and lower ends, respectively. Upper ring 12 and lower ring 16 may be sewn into shade 10, glued to shade 10, or otherwise adhered or permanently attached to shade 10. Although upper ring 12 and lower ring 16 are annular in the illustrated embodiment, the invention also comprises an upper ring 12 and lower ring 16 of other shapes, including square, triangular, polygonal, and the like. The shape of shade 10 must be matched to the shape of upper ring 12 and lower ring 16 such that shade 10 is taut when the invention is in the assembled state, as shown in FIGS. 1 and 3.

In the illustrated embodiment, spider member 14 lies within upper ring 12, and provides an attachment point between the invention and a lamp. Spider member 14 may be designed such that it fits directly to a lamp, or to an electric light bulb mounted in the lamp. Several standard shade attachment schemes are known in the art, and are used with various types of decorative lamps. In alternative embodiments, spider member 14 may lie within lower ring 16, or may be omitted altogether in favor of another means of attaching the lampshade to a lamp.

Figure 5:
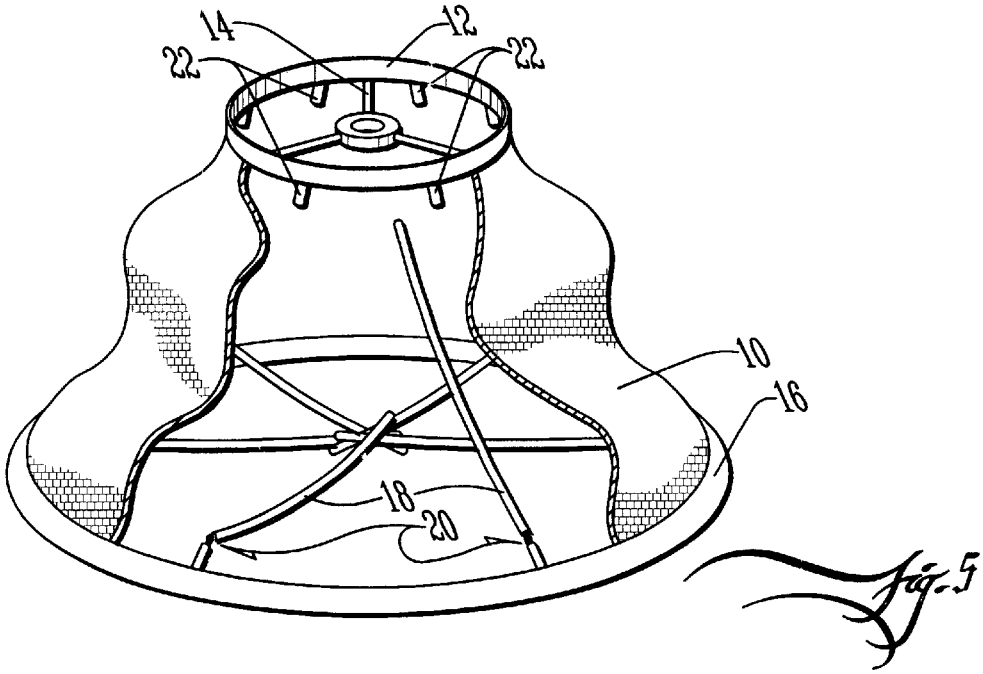
FIG. 5 is a partial cut-away view of a preferred embodiment of the invention in a partially collapsed state.
Figure 8:
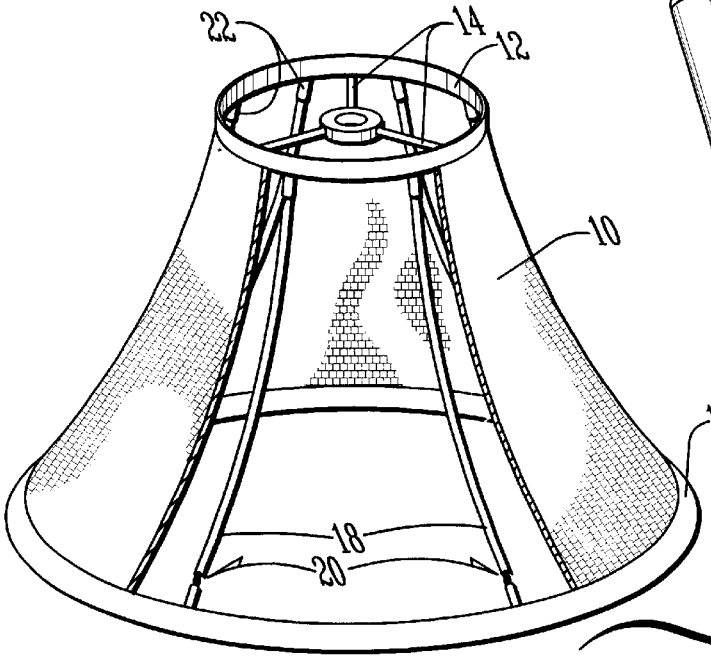
FIG. 8 is a partial cut-away view of a preferred embodiment of the invention in the assembled state.

Referring now to FIGS. 3, 5, and 8, supports 18 are permanently attached to lower ring 16, such that supports 18 extend upwardly within shade 10 when unfolded. Although in the illustrated embodiment six supports 18 are used, alternative embodiments may include any number of supports 18. In another alternative embodiment, supports 18 may be permanently attached to upper ring 12 instead of lower ring 16, or some of supports 18 may be attached to upper ring 12 while others of supports 18 are attached to lower ring 16.

Figure 4:
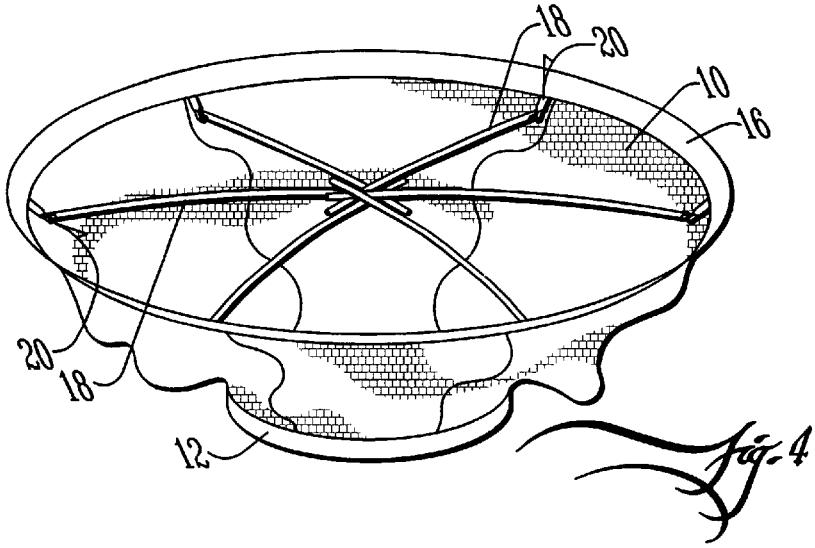
FIG. 4 is a bottom perspective view of a preferred embodiment of the invention in a partially collapsed state.
Figure 6:
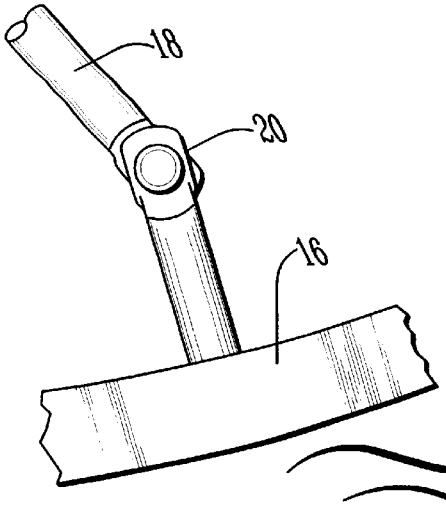
FIG. 6 is a detail elevational view of the hinge on a support of a preferred embodiment of the invention.
Figure 7:
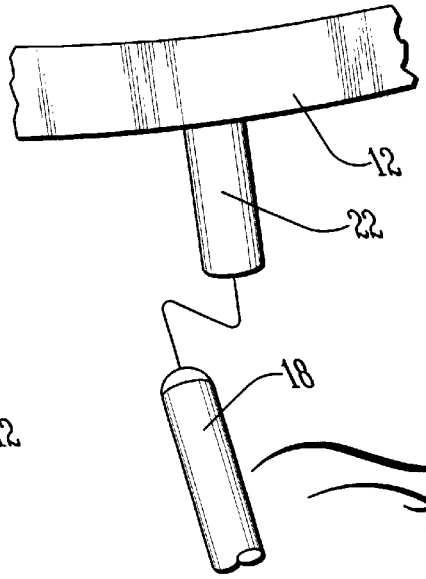
FIG. 7 is a detail elevational view of a receptacle and support end of a preferred embodiment of the invention.

Part-way along each support 18 is hinge 20, as shown in detail in FIG. 6. Each support 18 may pivot about hinge 20, such that the portion of support 18 opposite of hinge 20 from the attachment point of support 18 may lie flat for storage or shipment. In the collapsed state, the pivoted portion of support 18, upper ring 12, and lower ring 16 may all lie parallel, such that the lampshade takes up little space. In this state, shade 10 is folded loosely between upper ring 12 and lower ring 16, as shown in FIGS. 2 and 4. In the preferred embodiment, the portion of each support 18 below hinge 20 is short compared to the portion of each support 18 above hinge 20; in this way, the embodiment will be more compact when in the collapsed state.

To assemble the illustrated preferred embodiment of the invention from the collapsed state, the user need only unfold each support 18 such that hinge 20 is straightened, and slip the unattached end of each support 18 into the corresponding receptacle 22 on upper ring 12 as shown in FIG. 5. Upper ring 12 will have a number of receptacles 22 matching the number of supports 18. In the preferred embodiment, each receptacle 22 has an opening at its lower end designed to securely receive the unattached end of the corresponding support 18. In alternative embodiments, other types of receptacles 22 could be used, such as spring-loaded clips; any type of receptacle 22 may be used which will securely but removably lock the unattached end of support 18 in place with respect to upper ring 12. When supports 18 are received into receptacles 22, shade 10 is thereby pulled taut between upper ring 12 and lower ring 16 and outside of supports 18. The relative size and shape of upper ring 12 and lower ring 16, as well as the number of and curvature, if any, of supports 18, will determine the shape of shade 10 when the lampshade is in the assembled state.

The present invention has been described with reference to certain preferred and alternative embodiments that are intended to be exemplary only and not limiting to the full scope of the present invention as set forth in the appended claims.

What is claimed is:

1. A lampshade, comprising:

(a) a first ring;

(b) a shade having first and second ends, wherein said first ring is attached to said shade at said first end;

(c) a second ring attached to said shade at said second end; and (d) a plurality of supports attached to one of said first and second rings, wherein each of said supports comprises an unremovably attached end and an unattached end, and wherein at least a portion of each of said supports may be positioned to lie parallel to one of said first and second rings.

2. The lampshade of claim 1, wherein each of said supports comprises a hinge part-way along the length of said support.

3. The lampshade of claim 2, wherein for each of said plurality of supports, said hinge is closer to the attached end of said support than the unattached end of said support.

4. The lampshade of claim 2, further comprising a spider member attached to one of said first and second rings, said spider member lying substantially in the same plane with said one of said first and second rings.

5. The lampshade of claim 2, further comprising a plurality of receptacles attached to at least one of said first and second rings, wherein each of said receptacles is adapted to receive the unattached end of one of said supports.

6. The lampshade of claim 5, wherein each of said receptacles comprises an opening adapted to receive the unattached end of one of said supports.

7. The lampshade of claim 5, wherein said shade is permanently attached to at least one of said first and second rings.

8. The lampshade of claim 7, wherein said shade is permanently attached to both of said first and second rings.

9. The lampshade of claim 7, wherein each of said supports are permanently attached to one of said first and second rings.

10. The lampshade of claim 5, wherein said receptacles are clips adapted to receive said supports.

11. A lampshade frame, comprising:

(a) a first ring;

(b) a second ring;

(c) a plurality of supports, wherein each of said supports is unremovably attached to one of said first ring and said second ring, each of said supports is removably connectable to the other of said first ring and said second ring, and each of said supports may be folded to lie substantially flat.

12. The lampshade frame of claim 11, wherein said supports are hingeably attached to one of said first ring and said second ring.

13. The lampshade frame of claim 12, further comprising a spider member attached to one of said first ring and said second ring.

14. The lampshade frame of claim 13, further comprising a plurality of receptacles formed by at least one of said spider, said first ring, and said second ring.

15. The lampshade of claim 14, wherein said supports comprise an attached end and an unattached end, and said unattached end of each of said supports is adapted to fit against one of said receptacles.

16. The lampshade frame of claim 11, wherein said supports comprise a hinge.

17. The lampshade frame of claim 16, wherein said hinge is positioned on each of said supports such that when each of said supports is folded, the lampshade frame lies substantially flat.

18. The lampshade frame of claim 17, wherein each said hinge is positioned on one of said supports at about where said support comprising said hinge is attached to one of said first ring and said second ring.

19. A lampshade, comprising:

(a) a first ring;

(b) a second ring;

(c) a shade attached to at least one of said first and second rings; and (d) a plurality of supports attached to one of said first and second rings, each of said supports having an attached end and an unattached end, and wherein at least a portion of each of said supports may be positioned to lie parallel to one of said first and second rings such that the lampshade may fold flat into an area that is not significantly larger than the area of the larger of said first and second rings.

20. The lampshade of claim 19, wherein each of said supports comprises a hinge part-way along the length of said support.

21. The lampshade of claim 20, further comprising a spider member attached to one of said first and second rings, said spider member lying substantially in the same plane with said one of said first and second rings.

22. The lampshade of claim 20, further comprising a plurality of receptacles attached to at least one of said first and second rings, wherein each of said receptacles is adapted to receive the unattached end of one of said supports.

23. The lampshade of claim 22, wherein each of said receptacles comprises an opening adapted to receive the unattached end of one of said supports.

24. The lampshade of claim 19, wherein said supports are hingeably attached to one of said first and second rings.

25. The lampshade of claim 24, wherein said attached end of each of said supports is hingeably attached to one of said first and second rings, and said unattached end of each of said supports is adapted to fit against the other of said first and second rings.

26. A lampshade, comprising:

(a) a first ring;

(b) a second ring;

(c) a shade unremovably attached to at least one of said first and second rings; and (d) a plurality of supports unremovably attached to one of said first and second rings, each of said supports having an attached end and an unattached end, and wherein at least a portion of each of said supports may be folded flat.

27. The lampshade of claim 26, wherein each of said supports comprises a hinge part-way along the length of said support.

28. The lampshade of claim 27, further comprising a spider member attached to one of said first and second rings, said spider member lying substantially in the same plane with said one of said first and second rings.

29. The lampshade of claim 27, further comprising a plurality of receptacles attached to at least one of said first and second rings, wherein each of said receptacles is adapted to receive the unattached end of one of said supports.

30. The lampshade of claim 29, wherein each of said receptacles comprises an opening adapted to receive the unattached end of one of said supports.

31. The lampshade of claim 26, wherein said supports are hingeably attached to one of said first and second rings.

32. The lampshade of claim 31, wherein said attached end of each of said supports is hingeably attached to one of said first and second rings, and said unattached end of each of said supports is adapted to fit against the other of said first and second rings.

* * * * *

US006315434C1

(12) EX PARTE REEXAMINATION CERTIFICATE (4894th)

United States Patent

Long

(10) Number: US 6,315,434 C1

(45) Certificate Issued: Jan. 13, 2004

(54) ONE-PIECE COLLAPSIBLE LAMPSHADE

(75) Inventor: Alan M. Long, Little Rock, AR (US)

(73) Assignee: Cheyenne Industries, Inc., Little Rock, AR (US)

Reexamination Request:
No. 90/006,191, Jan. 15, 2002

Reexamination Certificate for:

| | |
|---|---|
| Patent No.: | **6,315,434** |
| Issued: | **Nov. 13, 2001** |
| Appl. No.: | **09/645,378** |
| Filed: | **Aug. 24, 2000** |

(51) Int. Cl.[7] ..... F21V 1/06

(52) U.S. Cl. ..... 362/352; 362/356; 362/358; 362/434; 362/450

(58) Field of Search ..... 362/351, 352, 362/355, 356, 357, 358, 434, 450

(56) References Cited

U.S. PATENT DOCUMENTS

| | | | | | |
|---|---|---|---|---|---|
| 487,858 | A | | 12/1892 | Spitzer | |
| 2,884,515 | A | * | 4/1959 | Fogel | 362/352 |
| 4,075,684 | A | * | 2/1978 | Witz | 362/352 |
| 4,120,027 | A | * | 10/1978 | Stark | 362/352 |
| 4,165,529 | A | * | 8/1979 | Hagelthorn | 362/352 |
| 4,212,052 | A | * | 7/1980 | Chambard | 362/352 |
| 4,233,656 | A | * | 11/1980 | Shemitz | 362/352 |
| 4,290,099 | A | * | 9/1981 | Vicars-Harris | 362/352 |
| 4,354,222 | A | * | 10/1982 | Gall | 362/352 |
| 4,605,996 | A | * | 8/1986 | Payne | 362/352 |
| 4,714,987 | A | * | 12/1987 | Dene | 362/352 |
| 4,727,461 | A | * | 2/1988 | Naumoff et al. | 362/352 |
| 4,731,716 | A | * | 3/1988 | Chang | 362/352 |
| 4,758,936 | A | * | 7/1988 | Maxwell | 362/294 |
| 4,772,992 | A | * | 9/1988 | Tang | 362/352 |
| 4,994,949 | A | * | 2/1991 | Yeh et al. | 362/352 |
| 5,375,048 | A | * | 12/1994 | Barnes | 362/352 |
| 5,868,492 | A | * | 2/1999 | Strickland | 362/352 |
| 6,030,087 | A | * | 2/2000 | Whittle | 362/352 |

FOREIGN PATENT DOCUMENTS

| | | |
|---|---|---|
| DE | 888532 | 9/1953 |
| FR | 2 583 501 | 12/1988 |
| GB | 12413 | of 1908 |

* cited by examiner

*Primary Examiner*—Stephen F. Husar

(57) ABSTRACT

A one-piece, collapsible lampshade is disclosed. The invention comprises an upper and lower ring, between which a shade is attached. Supports are permanently attached to one ring, with each support having a hinge part-way along its length. Receptacles are mounted on the opposite ring to receive the unattached end of the supports. The shade may be shipped and stored in the collapsed state by removing the unattached end of the supports from the receptacles and folding the supports flat. Because the shade is shipped and stored in one piece, it is easily and quickly assembled by the purchaser, without the risk of losing parts or of damage during shipment due to the movement of loose parts against one another.

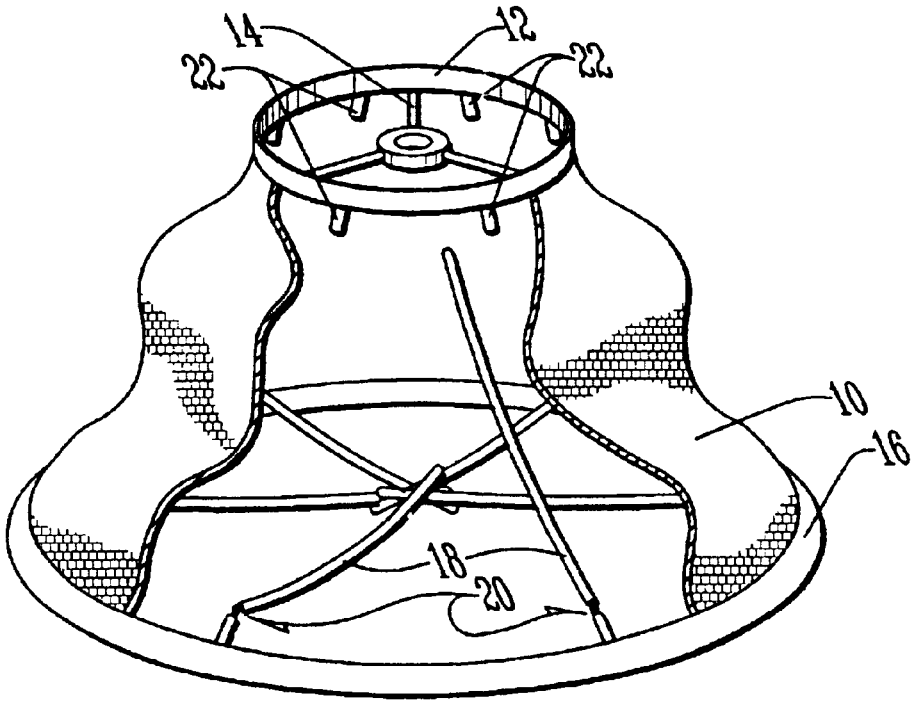

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–32 are cancelled.

* * * * *